US008276527B2

(12) United States Patent
Stepp

(10) Patent No.: US 8,276,527 B2
(45) Date of Patent: Oct. 2, 2012

(54) CORNER BOLT LOCKING SYSTEM

(75) Inventor: Richard E. Stepp, Springville, UT (US)

(73) Assignee: Prosteel Security Products, Inc., Provo, UT (US)

( * ) Notice: Subject to any disclaimer, the term of this patent is extended or adjusted under 35 U.S.C. 154(b) by 182 days.

(21) Appl. No.: 12/900,284

(22) Filed: Oct. 7, 2010

(65) Prior Publication Data

US 2011/0083591 A1 Apr. 14, 2011

Related U.S. Application Data

(60) Provisional application No. 61/249,657, filed on Oct. 8, 2009.

(51) Int. Cl.
*E05G 1/026* (2006.01)
*E06G 3/00* (2006.01)

(52) U.S. Cl. ..... 109/64; 109/59 R; 70/113; 292/36

(58) Field of Classification Search ..... 292/3, 8–10, 292/32, 35, 36, 41, 138, 139, 340, DIG. 53, 292/DIG. 55, DIG. 64; 109/64, 59 R; 70/113–116, 70/130
See application file for complete search history.

(56) References Cited

U.S. PATENT DOCUMENTS

| | | | | |
|---|---|---|---|---|
| 393,883 | A | | 12/1888 | Brown |
| 473,800 | A | | 4/1892 | Van Broek |
| 1,251,467 | A | | 1/1918 | Blixt |
| 1,600,982 | A | | 7/1922 | Golloway |
| 1,870,746 | A | | 5/1930 | Pyle |
| 1,929,341 | A | | 7/1932 | Wegner |
| 1,996,865 | A | | 1/1933 | Haag |
| 2,039,124 | A | | 12/1933 | Stryker |
| 1,966,272 | A | * | 7/1934 | Vance et al. ..... 70/118 |
| 2,823,536 | A | | 2/1958 | Watson |
| 2,860,584 | A | | 11/1958 | Deaton |
| 2,996,322 | A | | 8/1961 | McClellan |
| 3,308,579 | A | | 3/1967 | Thams |
| 3,582,120 | A | * | 6/1971 | Doerr et al. ..... 292/36 |
| 3,844,424 | A | * | 10/1974 | Ross et al. ..... 414/391 |
| 3,972,437 | A | * | 8/1976 | Lovich et al. ..... 220/1.5 |
| 4,669,394 | A | * | 6/1987 | Fogleman et al. ..... 109/59 T |
| 4,679,415 | A | | 7/1987 | Spratt |
| 5,088,776 | A | | 2/1992 | James |
| 5,094,483 | A | | 3/1992 | James |
| 5,595,076 | A | * | 1/1997 | Weinerman et al. ..... 70/208 |
| 5,601,201 | A | * | 2/1997 | Looker ..... 220/1.5 |
| 5,709,111 | A | * | 1/1998 | Henao ..... 70/104 |

(Continued)

OTHER PUBLICATIONS

Fort Knox Safe Company Website, http://www.ftknox.com/redesign/14points/cornerbolts.htm, retrieved Jul. 27, 2009.

(Continued)

*Primary Examiner* — Suzanne Barrett
(74) *Attorney, Agent, or Firm* — Ostrager Chong Flaherty & Broitman P.C.

(57) ABSTRACT

A corner bolt locking system for a safe or vault is disclosed for use with cam and link locking mechanisms and a generally rectangular door panel frame, having a corner hole through its corner. A reinforcement channel is disposed at the corner and aligned with the corner hole. A corner bolt link arm is pivotably attached to a rotatable pin cam plate, and a corner bolt is pivotably attached to the corner bolt link arm and positioned through the reinforcement channel and the corner hole.

22 Claims, 7 Drawing Sheets

U.S. PATENT DOCUMENTS 6,000,348 A * 12/1999 Do ..... 109/59 R
6,279,767 B1 * 8/2001 Yoon ..... 220/1.5
6,490,895 B1 * 12/2002 Weinerman et al. ..... 70/208
6,705,136 B2 * 3/2004 Porter ..... 70/210
6,843,084 B2 * 1/2005 Porter ..... 70/208
7,387,076 B2 * 6/2008 Bauman et al. ..... 109/59 R

OTHER PUBLICATIONS

Prosteel Cam and Link System Door Panel Locking Mechanisms.

* cited by examiner

CORNER BOLT LOCKING SYSTEM

RELATED APPLICATIONS

This application is a non-provisional application of co-pending provisional application No. 61/249,657 filed Oct. 8, 2009, the disclosure of which is incorporated herein by reference.

TECHNICAL FIELD

This disclosure relates generally to the field of firearm security safes and vaults and, more particularly, to improvements in safe or vault door locking systems.

BACKGROUND

Security safes for home and commercial use, and for the storage of firearms and other valuables, are well known. Typical safes are constructed to form a rectangular box having a hollow interior space used for storage and protection of items such as firearms. A security door is hingedly attached to either a top or side panel of a safe's rectangular frame to provide access to the interior space and to protect the safe from unwanted intrusion. Security doors are constructed with enhanced security features, such as multiple locking bolts or pins that simultaneously project from or retract into one or more sides of the door. The terms locking bolts and locking pins are used interchangeably herein. Such doors generally comprise a metal frame that forms the sides of the door ("door panel frame") through which locking bolts or pins protrude behind the frame of the safe body ("safe body frame") to secure the door in a locked position. Many such security doors utilize complicated configurations of camming grooves, pin followers and pivotally linked bars to simultaneously move the multiple bolts. See, e.g., U.S. Pat. No. 5,111,674 to Huang, U.S. Pat. No. 5,096,238 to Mintz, U.S. Pat. No. 4,470,277 to Uyeda.

Applicant's firearm safes are generally rectangular in shape and have a hinge-mounted door that provides access to the safe's interior compartment(s). The door is situated in a rectangular frame at the front of the safe. To provide security, the door is fitted with a locking system on an interior surface of the door. Typically, the door is provided with an interior panel that covers the locking mechanism, and sometimes provides additional gun safe features such as a rifle rack or storage pockets, for example, as shown and described in Applicant's U.S. Pat. No. 7,409,790 entitled "Gun Safe Door Storage System," the disclosure of which is incorporated in its entirety by reference herein.

It has been found that a common form of unauthorized entry into a safe is to pry the door open using the space between the door panel frame and the safe body frame, which is typically quite small. The larger the gap between the safe body frame and the door panel frame, the easier it is to get pry tools into the gap. For example, if a 0.25" gap exists between the safe body frame and the door panel frame it is much easier to get a pry tool wedged into the opening and begin prying open the door. The smaller the gap, the more difficult it is to begin prying open the door. Tests have shown that the best method for prying open a safe door is to tip the safe over onto its back and to push the door panel frame to the top of the safe body frame. This may double the gap at the bottom of the safe. If there was initially a 0.15" gap on all four sides, then once the door panel frame is pushed to the top of the box, the top gap will be eliminated and the sides will be maintained a 0.15" gap, but the bottom gap will increase to 0.30". Thus, the bottom corner of the door panel frame is often a weak link.

If the door panel frame and safe body frame are not of sufficient strength or configuration, or the locking mechanism is not sufficiently strong, the door panel frame may be pried away from the safe body frame by spreading the safe body frame apart from the door panel frame to create an opening large enough for the locking pins to slip past the safe body frame and allow the door to be opened. Alternatively, a tool may be used to deform the locking pins and/or the pin bar, which may allow the locking pins to slip past the safe body frame.

During testing it was found that the four corners of the safe are the most difficult areas to pry apart. This is logical as this is where two pieces of steel with multiple bends are coming together at 90 degree angles and significantly reinforcing each other. Positioning locking pins in the corners of the door that extend into the corners of the frame takes advantage of this strong area of the safe.

Prior art safes have utilized corner locking pins to improve resistance to pry attacks but have done so using complex and expensive parts. For Example, U.S. Pat. No. 5,088,776 to James discloses a safe door with multiple locking pins around the periphery of the safe door, including in the corner of the safe door. The corner locking pins are actuated with expensive and complicated rack and pinion gear systems, and the corner locking pins themselves are complicated parts comprising a stud affixed to a rack gear. The complexity of the rack and pinion gear system also requires a great deal of time for assembly and maintenance. Such systems therefore increase the cost of manufacturing, maintaining and repairing the safe, which results in increased expense for the consumer.

There exists a need to provide a cost effective pin locking system for safe doors, including corner locking pins, that uses minimal parts, and is easy to manufacture, assemble, repair and maintain.

SUMMARY

The locking system disclosed herein provides an improved corner pin (also referred to as corner locking pin or corner bolt) arrangement and construction, using a system of cams and links to actuate the corner locking pins instead of complicated gear driven mechanisms. The locking system is provided for use with a generally rectangular door panel frame, the door panel frame defining a corner hole through at least one of its corners. A reinforcement channel is disposed at the at least one corner of the door panel frame, and is aligned with the hole in the door panel frame. A corner bolt link arm is pivotably attached to a rotatable cam plate. A corner bolt is pivotably attached to the corner bolt link arm and is positioned through the reinforcement channel and the corner hole, such that when the pin cam plate is rotated, force is applied through two pivot points to move the corner bolt through the reinforcement channel and the corner hole. The corner pin is thereby moved between a locked position wherein an outer end of the corner bolt extends past an outer edge of the at least one corner of the door panel frame and un-locked position wherein the outer end of the corner bolt is unextended.

The corner reinforcement channel may be U-shaped, providing two surfaces through which the corner bolt passes in addition to the corner hole. The outside end of the corner bolt may be chamfered to provide a flush surface with an outer edge of the door panel frame when the corner bolt is in the un-locked position and to allow it to protrude behind the frame of the safe body when in a locked position. The internal end of the corner bolt may be attached to an L-shaped bracket positioned to be pressed against an interior surface of the door panel for further resistance against pry attacks.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Other objects, features and advantages of the present invention will be apparent when the disclosure is considered in conjunction with the drawings set forth herein, which should be construed in an illustrative and not limiting sense.

BRIEF DESCRIPTION OF THE DRAWINGS

The present invention is described in detail below with reference to the attached drawing figures, wherein.

Reference will hereinafter be made to the drawings in which similar elements in different drawings bear the same reference numerals.

DETAILED DESCRIPTION OF THE DRAWINGS

In the following detailed description, certain preferred embodiments are described as illustrations in order to provide a thorough understanding of the present invention. Those methods, procedures, components, or functions which are commonly known to persons of ordinary skill in the field of the invention are not described in detail as not to unnecessarily obscure a concise description of the present invention. Certain specific embodiments or examples are given for purposes of illustration only, and it will be recognized by one skilled in the art that the present invention may be practiced in other analogous applications or environments and/or with other analogous or equivalent variations of the illustrative embodiments.

General Construction

Figure 1A:
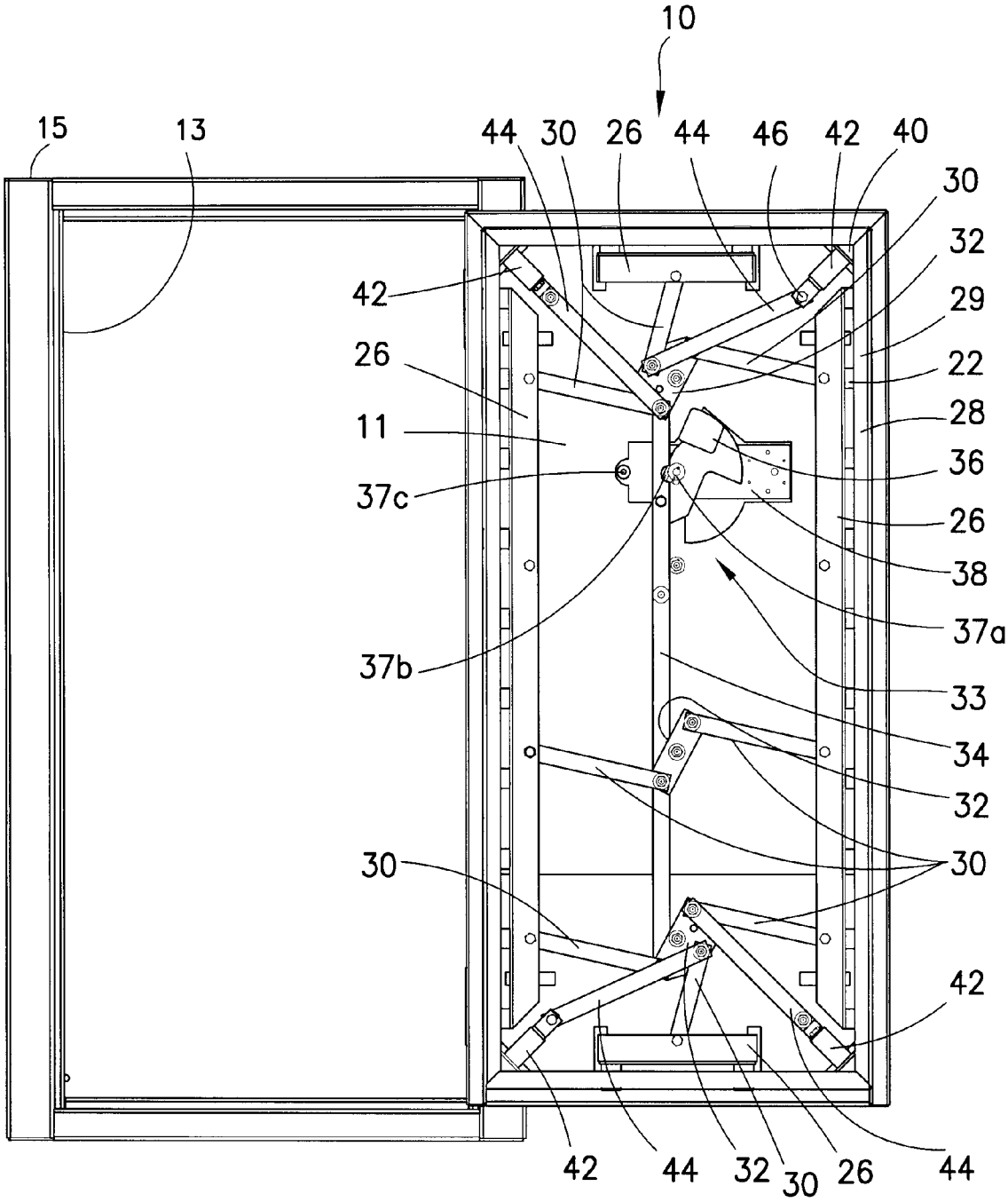
FIG. 1A is a front view of an open safe displaying the safe door locking system in an un-locked position.

A safe door 10 having corner locking pins (or corner bolts) 42 actuated by a cam-link locking system 33 is shown in FIG. 1A. Door 10 is depicted as hingedly connected to safe body 15. The locking system 33 is depicted in an unlocked position, such that all of the locking pins (side locking pins 22 and corner locking pins or corner bolts 42) would be unextended and the door 10 may be opened or closed. The side locking pins 22 are mounted on movable pin bars 26 and are supported by and extend through a door panel frame 28. Preferably, the door panel frame 28 has a flange 29 which hangs over the door panel surface 11. Preferably, each side and the top of the door have their own pin bar 26, side locking pins 22, and door panel frame 28. The corner locking pins 42 and side locking pins 22 may be extended behind safe body frame 13.

Each of the pin bars 26 has one or more link arms 30 pivotally linking the pin bar 26 to a rotatable pin cam plate 32. The locking system 33 is provided with a plurality of rotatable pin cam plates 32 (three being depicted in FIG. 1—near the top, bottom, and middle of the door). These cam plates 32 are connected via a synchronizing link arm 34, which is also pivotally connected to a rotatable locking mechanism cam plate 36. The locking mechanism cam plate 36 is connected to a rotatable handle on the exterior surface of the door via a shaft journaled through the door. A lock (not shown) could be provided and attached to hard plate 38 for preventing rotation of the exterior handle.

The side locking pins 22 are usually press-fitted into a hole in the pin bar 26, which is typically an L-shaped bar. Bars in other shapes have been employed, such as a U-shaped channel, in an effort to increase the bar's strength. However, a U-shaped channel requires each pin 22 on the pin bar 26 to be increased in length, which adds additional cost with minimum anti-pry strength increase. The pins are retained in the door panel frame 28 near the edge of the door.

Figure 1B:
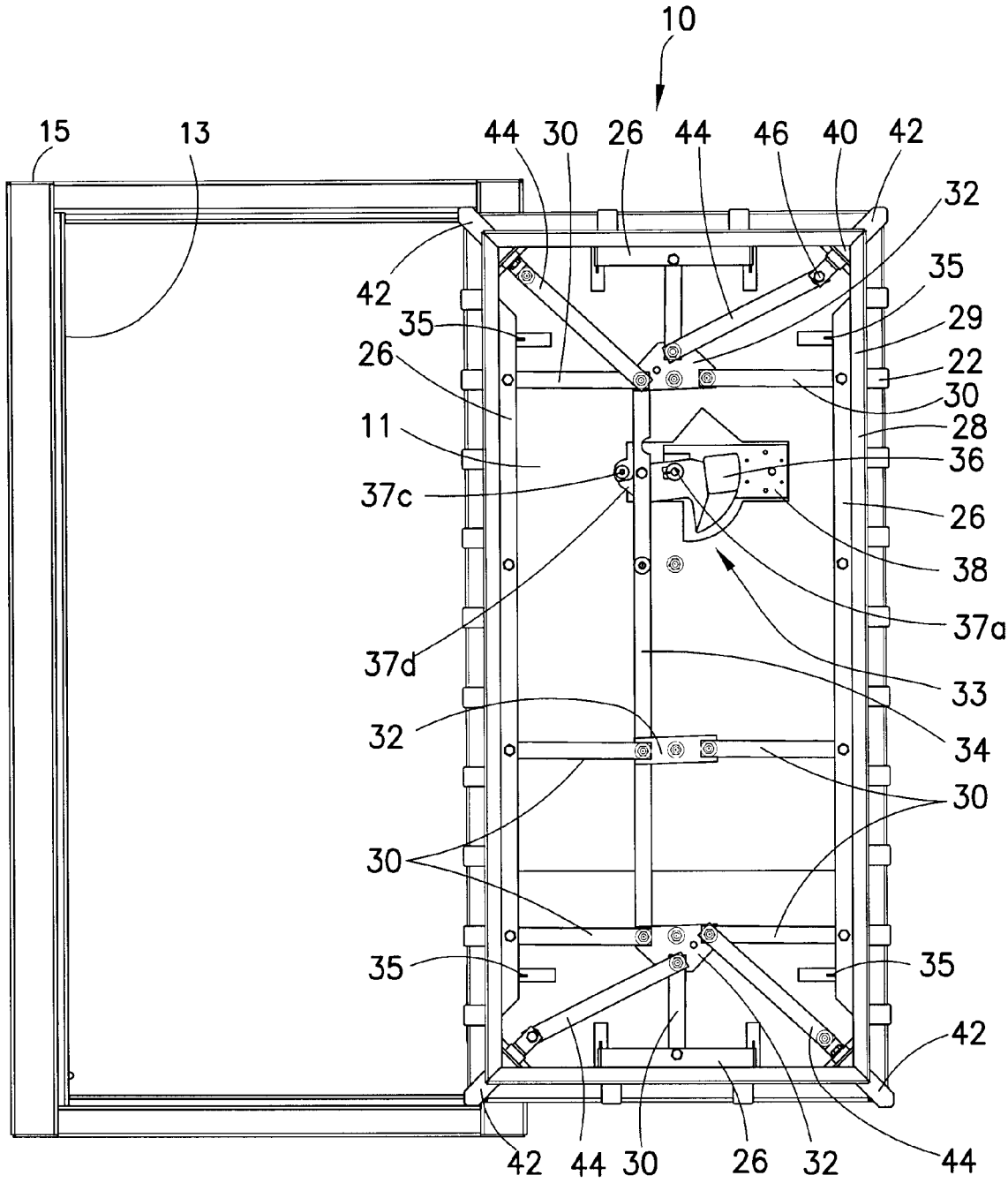
FIG. 1B is a front view of an open safe displaying the safe door locking system in a locked position.
Figure 3:
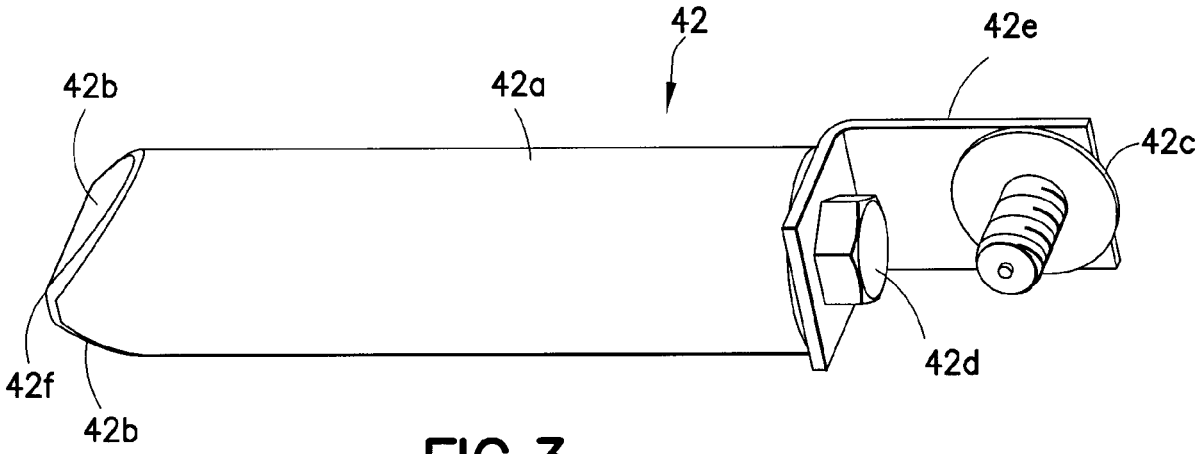
FIG. 3 is a perspective view of a corner bolt with a chamfered edge that may be used in the safe door locking system.

In addition to the side locking pins 22 described above, the safe door 10 also preferably has corner locking pins 42. As can be seen in FIGS. 1A, 1B and 3, the corner bolt 42 is pivotably attached, via a pivoting member 46 to a corner bolt link arm 44, which in turn is pivotably attached to a cam plate 32. As depicted, the corner bolt link arms 44 are attached to corners of triangular shaped cam plates 32. However, it should be recognized that the link arms 44 may be attached to any point on the cam plate 32 that allows cam plate rotation to advance the corner bolts 42 towards the corners of the door. Thus the cam plate 32 may be any shape or configuration which allows rotation of the cam plates to advance all corner bolts in the same direction.

Figure 2:
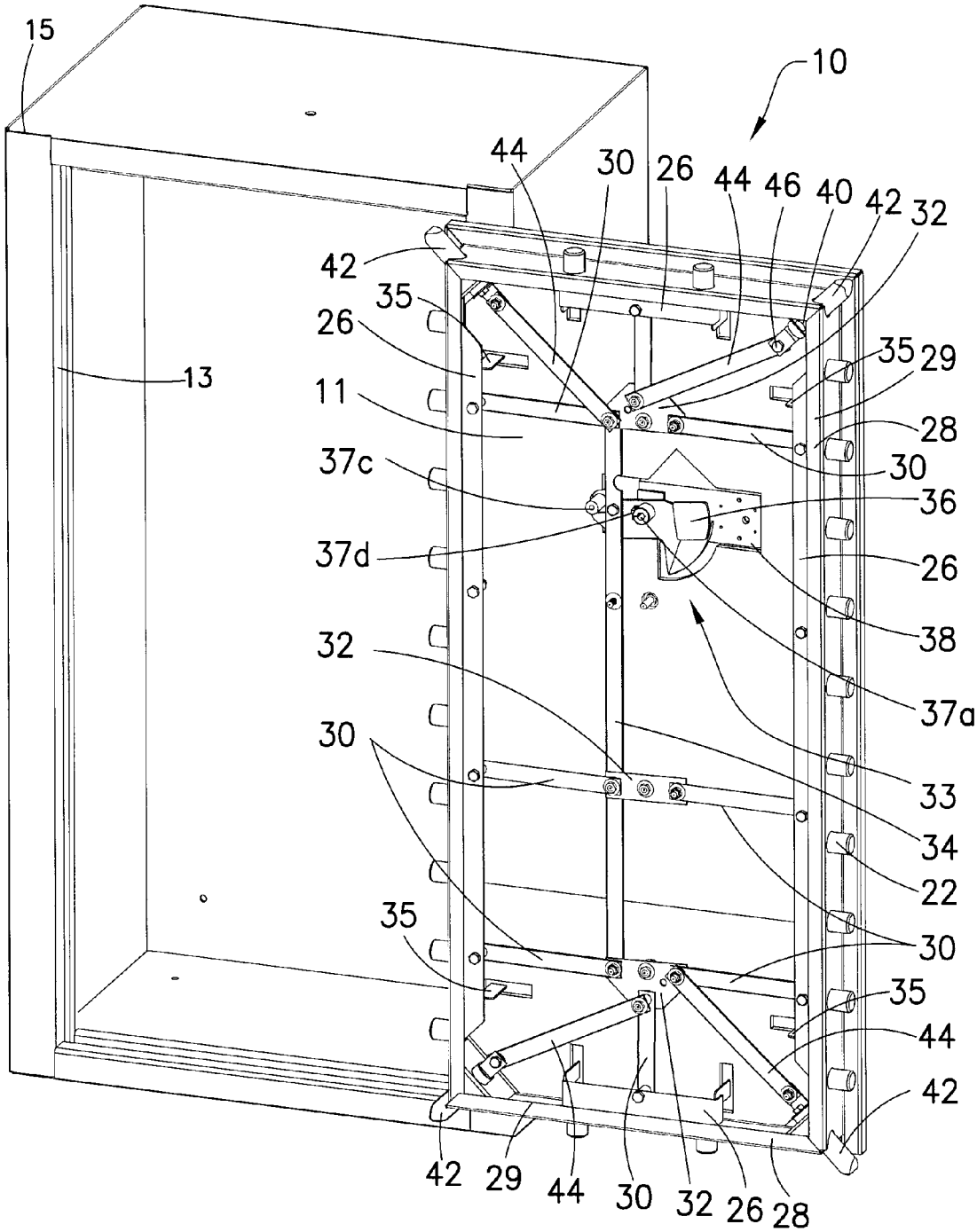
FIG. 2 is a perspective view of an open safe displaying the safe door locking system in a locked position.

To prevent rotation of the locking mechanism cam plate 36 past fixed bounds, stops are provided which catch the plate. Notch 37*b* is provided on synchronizing link arm 34 so that during rotation, pivot point 37*a* for the locking mechanism cam plate fits into notch 37*b* and does not interfere with synchronizing link arm 34 operation while the system is rotating to the unlocked position. Chips 35 (seen in FIGS. 1B and 2) interact with and provide a limit to the inward motion of pin bars 26. Stop 37*c* is provided on the door panel 11 or on the lock 38 and interacts with stop tip 37*d* (shown in FIG. 1B). Stop 37*c* and stop tip 37*d* prevent rotation of the locking mechanism cam plate 36 past a certain point in the closed position.

During testing, it was found that a cam and link mechanism would normally bind when attached to a corner bolt 42 due to the fact that the direction of the force provided by a cam link arm 44 to the corner bolt 42 would not be in the same direction as the motion of the corner bolt 42. Referring to FIG. 1A, it can be seen that the cam link arm in the upper right corner 44 is not pointed in a 45-degree direction. Therefore, special features were added to the corner bolt 42 to make it compatible with the cam and link system, including the use of dual pivot points for the corner bolt cam link arm 44 and a reinforcement channel 40 (seen in FIGS. 4, 7 and 8) providing additional guidance to the corner bolt 42, to prevent it from binding. Without the reinforcement channel 40, the corner bolt would only be guided by a single hole through the corner of the door panel frame 28, which would lead the corner bolt 42 to be pushed at an improper angle and to bind against the door panel frame 28. However, with the provision of the reinforcement channel 40 preferably having two additional holes (as described below), proper guidance is provided to the corner bolt 42 which can then be moved in the proper direction by the cam and link system.

Further, improved security may be obtained by maintaining 90-degree angles at the corners of the door panel frame 28. This allows the use of a much longer corner locking pin that is more difficult to pry open. Installation of a corner reinforcement channel 40 provides this pry-resistance benefit as well. The reinforcement channel 40 provides an additional reinforcement plane that strengthens the pry resistance of the corner locking pin 42. One embodiment of a suitable reinforcement channel is described below as a generally U-shaped channel having one side of the "U" larger than the other, and an aperture through both sides of the "U" to retain the locking pin, thus providing 2 additional points of contact between the corner locking pin 42 and the door panel frame 28. The dimensions of the reinforcement channel may be adjusted depending on the size of the safe and the door panel frame.

Figure 4:
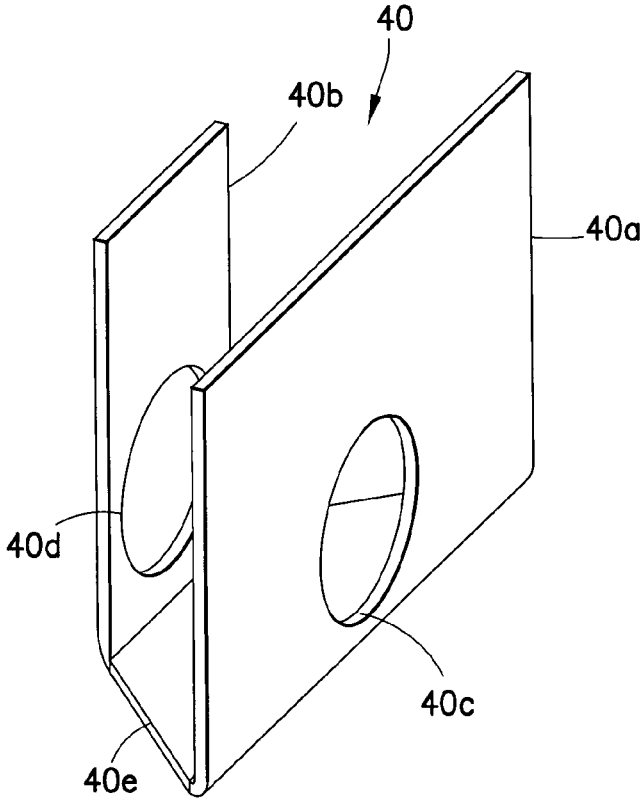
FIG. 4 is a perspective view of a corner reinforcement channel that may be used in the safe door locking system.
Figure 7:
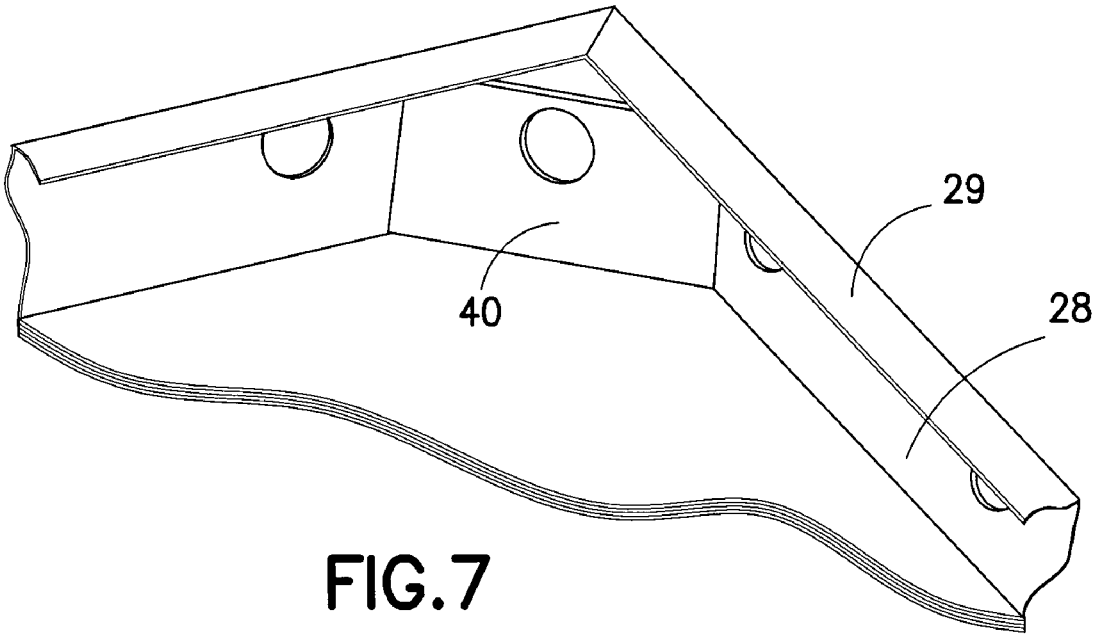
FIG. 7 is a partial perspective view of a corner of a door panel frame including the corner reinforcement channel.
Figure 8:
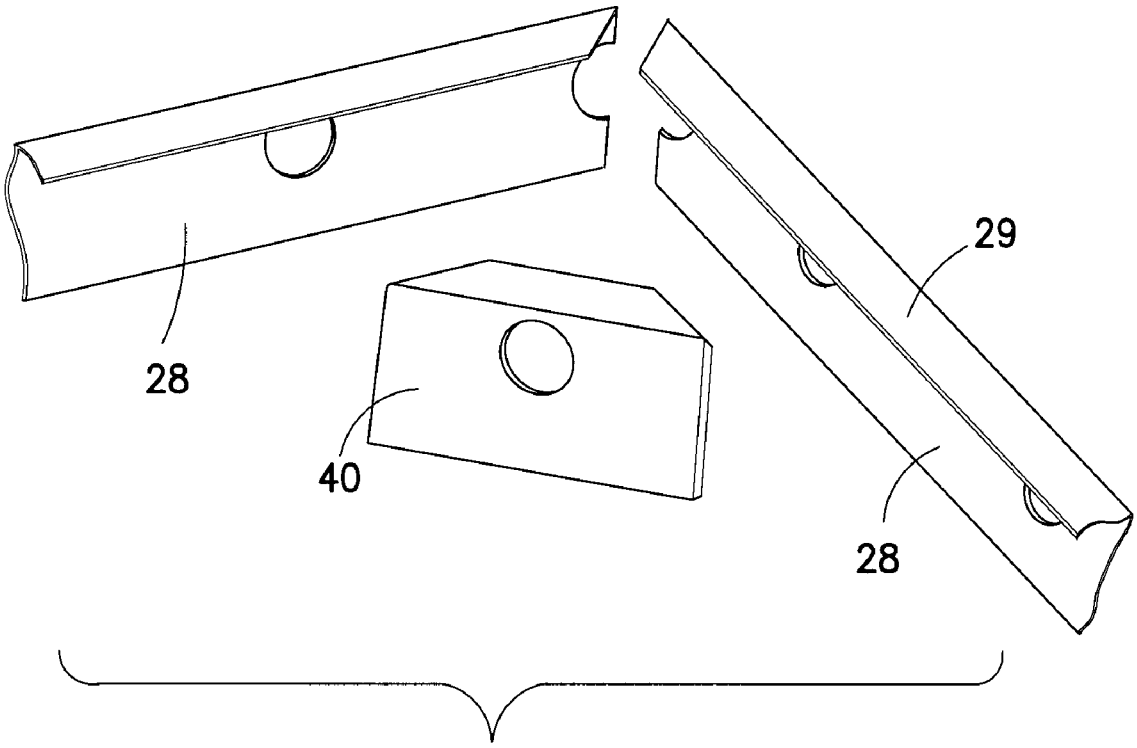
FIG. 8 is an exploded view of the corner reinforcement channel and door panel frame shown in FIG. 7.

Referring to FIGS. 4, 7 and 8, the reinforcement channel 40 preferably comprises first 40*a* and second 40*b* parallel and spaced apart surfaces attached by a third surface 40*e*. Surfaces 40*a* and 40*b* each have holes 40*c*, 40*d* which are aligned to allow corner bolts 42 to pass through. Surfaces 40*a*, 40*b*, and 40*e* are shaped to fit snugly into the corner area defined by the door panel frame 28. Preferably, this means that surface 40*a* is wider than surface 40*b*, and surface 40*e* is tapered appropriately. The dimensions of the channel 40 may be adjusted to accommodate the dimensions of the safe door 10. Preferably, the spacing between the parallel surfaces 40*a* and 40*b* is approximately ½ inch to 5 inches, more preferably approximately 2 inches.

The reinforcement channel 40 also provides strengthening of the corner of the door, providing a welded gusset between each side of the door panel frame 28. The channel 40 is preferably welded on all sides to the door panel frame 28, to provide maximum strength and pry-resistance. Specifically, the channel 40 is preferably oriented such that connecting surface 40*e* is raised above the door panel surface 11 and is adjacent the flange 29 of the door panel frame 28. The door panel frame 28 is welded to the left and right sides of surface 40*a*, the door surface is welded to the bottom side of surface 40*a*, and the flange 29 is welded to surface 40*e*. Preferably, to reduce friction, noise and wear on the parts, a plastic grommet can be inserted into the hole(s) in the reinforcement channel 40.

Referring to FIG. 3, a corner bolt 42 is shown having a pivot fastener 42*c*, pivot bracket 42*e*, pivot bracket bolt 42*d*, and corner bolt body 42*a*. The edges of the corner bolts 42 may be chamfered to match the outer edge of the door panel frame 28. The chamfered edges 42*b* allow the pin 42 to protrude further into the safe body frame 13 without having to remove as much fire insulation, thus improving the fire rating. In preferred embodiments, the corner locking pin edges 42*b* should be chamfered to be substantially parallel to each side of the door panel frame 28, but leaving a flat top edge 42*f*. The top edge 42*f* of the corner locking pin 42 is typically but not limited to 0.10-0.50" in length. The chamfered edges 42*b* are preferably at an approximately 45 degree angle from top edge 42*f*. Pivot fastener 42*c* allows pivot bracket 42*e* to pivot with respect to corner bolt arm 44. Preferably, pivot bracket 42*e* is attached to the rear of corner bolt body 42*a* by bolt 42*d*, but may also be welded.

Figure 5:
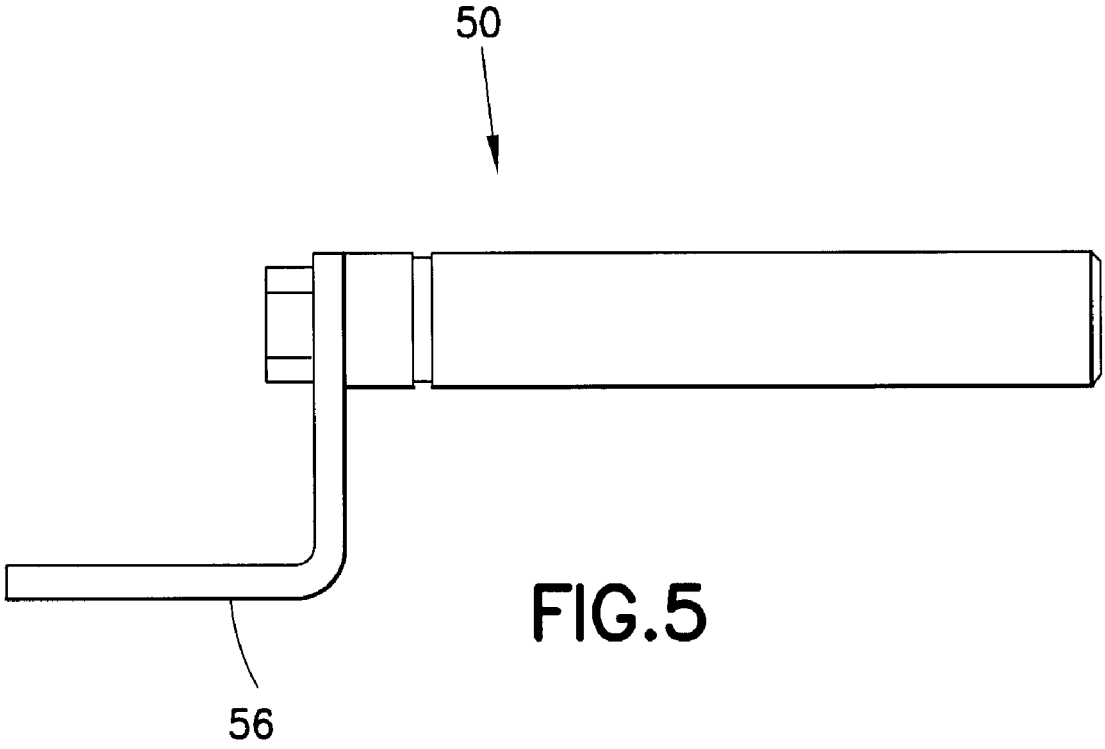
FIG. 5 is a side view of a pry-stopper bolt that may be used in the safe door locking system.
Figure 6:
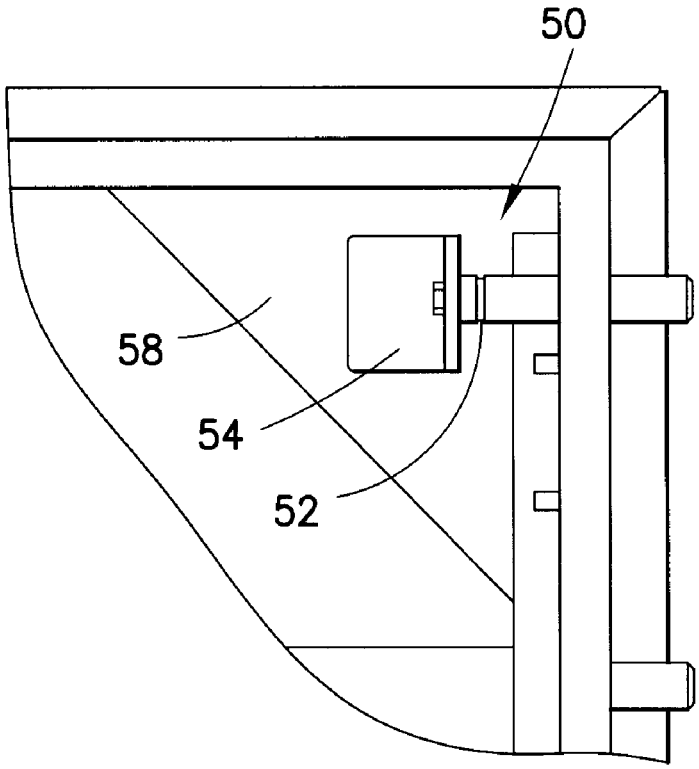
FIG. 6 is a partial plan view of a door utilizing the pry-stopper bolt shown in FIG. 5.

Referring to FIGS. 5 and 6, to further improve pry-resistance, locking pins at the ends of the pin bars (near the corners of the door) may be strengthened by increasing their length and providing a strong angle plate 54 affixed to a rear end of the pin that is supported by a metal support plate 58 on the interior surface of the door 10.

The improved end pin 50 (or angle plate pin) comprises a pin that has an increased length relative to the other side locking pins 22, in one embodiment said length being between 5 and 7 inches, and is provided with a threaded interior end 52 for attachment to a steel L-shaped reinforcement plate 54. The pin is welded to the pin bar and bolted to the L-shaped reinforcement plate 54. The L-shaped reinforcement plate 54 is sized such that, to avoid friction, the free end 56 of the plate 54 is raised approximately ⅛ inch above the metal support plate 58 on the interior surface of the door 10 but will engage support plate 58 if under pry attack pressure. The preferred thickness of the L-shaped reinforcement plate 54 is 0.125"-0.25". The metal support plate 58 on the interior surface of the door 10 may be of any size sufficient to support the L-shaped reinforcement plate 54. In a preferred embodiment, the support plate 58 covers the entire corner of the door 10 and extends past the L-shaped reinforcement plate 54 by at least 2 inches to provide for ample coverage during retraction of the locking pins. The thickness of the metal support plate can range from 0.0747"-0.1875". This arrangement provides end pin assembly that is steel on steel on steel.

A typical pin bar 26 has between 4 to 10 locking pins 22. On a typical safe, the more locking pins, the stronger the pry resistance. By replacing only the top and bottom pins of a 4 pin bar with the strengthened end pins 50 described above, the 4 pin bar becomes stronger than a 10 pin bar. The middle pins on the 4 pin bar may also be changed to the strengthened end pins described above, but this would add additional cost while the added strength would be minimal due to the nature of the attack. By changing the end pins only, the safe gained an unforeseen benefit of achieving maximum strength with minimum added expense.

It is believed that the new end pin construction provides increased strength for the following reasons: (1) the fulcrum of the pry force is moved further away from the attack point; (2) the force of the pry-attack is transferred into the steel reinforced door; (3) the thicker steel reinforcing angle plate distributes the attack force over a much larger area, dramatically diminishing the forces (i.e., an angle plate is mounted to the distal end of the bolt furthest from the pry force); and (4) a standard bolt is used to attach the pin to the reinforcing angle plate, and the pin is fully welded to the pin bar, whereas standard safe bolts are pressed into the angle bar. The combination of the foregoing features produces a locking pin that is nearly impossible to deform during a pry attack.

A further difference between the standard locking pins and the improved end locking pin 50 is seen in comparison to prior art recessed pin guide that served to keep the pin bar aligned during retraction and extension. These prior art guides comprised an L-shaped bracket that was welded to the door frame and had a hole through which end bolts could pass. These guides also added some pry resisting benefit. However, the assembly of these guides was difficult due to the requirement that all end pins be aligned to the holes defined by the guides which were already welded to the door. Also, these guides were anchored to the door and the pins simply passed through a clearance hole. In the improved end pin design, the reinforcing L-shaped plate is bolted directly to the pin, and the entire assembly retracts and extends as one unit eliminating potential alignment issues. Through-bolting the plate to the pin is also significantly stronger than a bolt passing through a clearance hole. Over time, clearance holes lose their tolerances as the locking mechanism is repeatedly actuated and the safe door is open and closed. Eventually what was once a tight fit between the locking pins and the hole becomes a loose fit. When this condition occurs, the locking pins offer a reduced pry resistance because they shift side to side in the holes rather than maintaining a rigid position.

Figure 9:
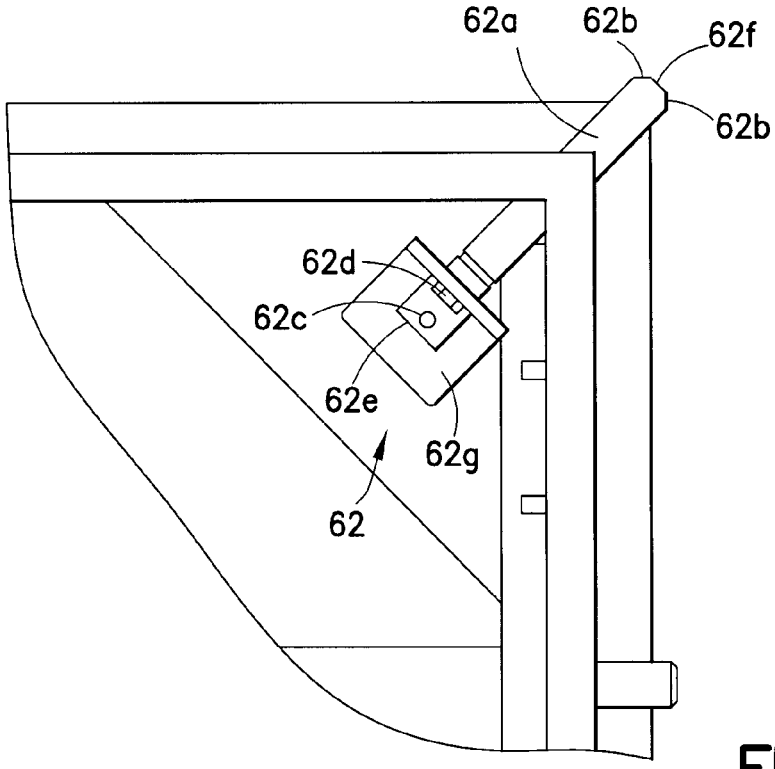
FIG. 9 is a plan view of a corner bolt with a pry-stopper attachment shown in a safe door.
Figure 10:
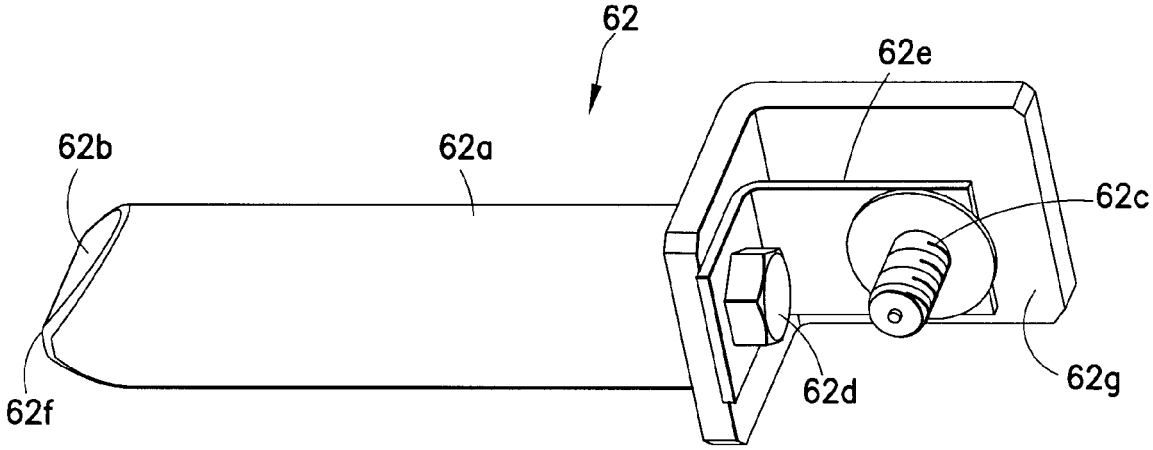
FIG. 10 is a perspective view of a corner bolt with a pry-stopper attachment.

As seen in FIGS. 9 and 10, the features of this improved end pin may also be applied to the corner bolt to improve pry resistance of that bolt. A modified corner bolt 62 is shown attached to an L-shaped corner bolt angle plate 62*g*. The modified corner bolt 62 has a pivot fastener 62*c*, pivot bracket 62*e*, pivot bracket bolt 62*d*, and corner bolt body 62*a*. The corner bolt angle plate 62*g* is preferably attached, along with the pivot bracket, to the rear of the bolt body 62*a*, with pivot bracket bolt 62*d*. Pivot fastener 62*c* attaches the modified corner bolt 62 to a corner bolt link arm 44.

The edges of the corner bolt 62 may be chamfered to match the outer edge of the door panel frame 28. The chamfered edges 62*b* allow the pin 62 to protrude further into the safe body frame 13 without having to remove as much fire insulation, thus improving the fire rating. In preferred embodiments, the modified corner bolt edges 62*b* should be chamfered to be substantially parallel to each side of the door panel frame 28, but leaving a flat top edge 62*f*. The top edge 62*f* of the corner bolt 62 is typically but not limited to 0.10-0.50" in length. The chamfered edges 62*b* are preferably at an approximately 45 degree angle from top edge 42*f*.

The angle plate 62*g* attached to the modified corner bolt 62 provides additional pry resistance by providing a structure to press against the door panel 11 or a metal support plate 58 attached to the door panel 11. When a pry attack is made, the tip of the bolt is lifted up, pivoting the bolt 62 around the door panel frame 28, which pushes the rear part of the bolt 62 downwards. With an angle plate 62*g* attached to the rear of the bolt, the downwards motion is severely restricted, preventing lifting of the front of the bolt out of the safe body frame 13, thereby strengthening pry attack resistance.

Operation

In operation, an unlocked door 10 (shown in FIG. 1A) is closed into the safe body 15 and against the safe body frame 13 and a user rotates the exterior handle (not shown) to lock the door 10. Upon rotation, the locking mechanism cam plate 36 is rotated clockwise in the view shown in FIG. 1A, and the synchronizing link arm 34 is moved upwards, causing the cam plates 32 to pivot clockwise. When the cam plates 32 pivot, the link arms 30, 44 are caused to move toward the perimeter of the door 10, which in turn moves the pin bars 26, the side locking pins 22 and corner locking pins 42 towards the perimeter of the door such that the pins 22, 42 extend beyond the outside edges of the door panel frame 28, thus locking the door to the safe body frame 13. The locking action of the cam plates 32, 36 and link arms 30, 34 preferably requires only about a ¼ turn of the exterior handle, and a stop may be provided to catch an edge of the locking mechanism cam plate 36 to prevent further rotation.

From the locked position in FIG. 1B, when a user unlocks the door in this configuration (i.e., by turning the exterior handle in the opposite direction), the locking mechanism cam plate 36 rotates counter-clockwise, moving the synchronizing link arm 34 in the opposite direction, which rotates the cam plates 32 counter-clockwise. All of the link arms 30, 34 are pulled inward thus pulling the pins inward and unlocking the door.

During rotation of the cam system, the corner bolt link arm 44 provides improperly directed force to the corner locking pin 42, which would normally cause it to bind against the surface of the door panel frame 28. Placement of the reinforcement channel 40 with one or two additional holes, which act as contact points for the corner bolt 42, guides the corner bolt 42 in the direction of the alignment of the holes, which should be approximately 45 degrees outwards from the corner of the door panel frame 28. Further, placement of a pivot point on the rear of the corner bolt 42 allows the corner bolt 42 to remain aligned in the approximately 45 degree direction while the corner bolt link arm 44 rotates due to the motion of the cam plate 32. Thus the two pivot points (at the cam plate 32 and the rear of the corner bolt 42) and the additional one or two contact points permits use of a cam and link system with corner bolts 42, and associated cost savings.

Although the inventions have been described with reference to preferred embodiments, which should be construed in an illustrative and not limiting sense, it will be appreciated by one of ordinary skill in the art that numerous modifications are possible in light of the above disclosure. For example, the locking mechanisms, pins and other structures described herein may be equally applicable to safe doors, vault doors and any other type of door for which added security is desired. All such variations and modifications are intended to be within the scope and spirit of the invention.

I claim:

1. A locking system for a door, comprising:

a generally rectangular door panel frame defining a corner hole through at least one corner of the door panel frame;

a reinforcement channel disposed at the at least one corner and aligned with the corner hole;

a corner bolt link arm pivotably attached to a rotatable pin cam plate;

a corner bolt pivotably attached to the corner bolt link arm and positioned through the reinforcement channel and the corner hole; and a pin bar having locking pins positioned proximate the door panel frame and pivotably attached to a pin bar link arm, the pin bar link arm being pivotably attached to the pin cam plate, the pin cam plate comprising a link arm attachment point to which both the corner bolt link arm and the pin bar link arm are pivotably attached.

2. The locking system of claim 1, wherein the reinforcement channel comprises at least one surface defining a reinforcement hole that is aligned with the corner hole.

3. The locking system of claim 1, wherein the reinforcement channel comprises two generally parallel and spaced apart surfaces, each of the surfaces defining a reinforcement hole that is aligned with the corner hole.

4. The locking system of claim 3, wherein the reinforcement channel comprises a U-shaped channel having tapered edges to fit into the at least one corner of the door frame.

5. The locking system of claim 1, wherein, when the pin cam plate is rotated, the corner bolt is movable between a locked position wherein an outer end of the corner bolt extends past an outer edge of the at least one corner of the door frame and an un-locked position wherein the outer end of the corner bolt is unextended.

6. The locking system of claim 5, wherein the outer end of the corner bolt is chamfered such that the outer end of the corner bolt is shaped similarly to the outer edge of the at least one corner of the door frame.

7. The locking system of claim 1, wherein the corner bolt comprises a threaded interior end attached to one side of an L-shaped bracket, the other side of the L-shaped bracket being pivotally attached to the corner bolt link arm.

8. The locking system of claim 4, wherein the space between the two generally parallel and spaced apart surfaces is approximately ½ inch to 5 inches.

9. The locking system of claim 4, wherein the reinforcement channel is welded to the door panel frame and to the door panel.

10. The locking system of claim 1, wherein the corner bolt comprises a threaded interior end attached to a first perpendicular surface of an L-shaped angle plate, said L-shaped angle plate having a second perpendicular surface which is facing and substantially near the surface of the door, thereby assisting in preventing pry attacks.

11. A door for a safe or vault, comprising:

a generally rectangular door panel frame defining a corner hole through at least one corner of the door panel frame;

a U-shaped reinforcement channel disposed at the at least one corner of the door panel frame, the channel comprising two generally parallel and spaced apart surfaces, each of the surfaces defining a reinforcement hole that is aligned with the corner hole of the door panel frame, the channel having tapered edges to fit into the at least one corner;

a corner bolt link arm pivotably attached to a rotatable pin cam plate; and a corner bolt pivotably attached to the corner bolt link arm and positioned through the reinforcement channel and the corner hole.

12. The door of claim 11, wherein, when the pin cam plate is rotated, the corner bolt is movable between a locked position wherein an outer end of the corner bolt extends past an outer edge of the at least one corner of the door frame and an un-locked position wherein the outer end of the corner bolt is unextended.

13. The door of claim 12, wherein the outer end of the corner bolt is chamfered such that the outer end of the corner bolt is shaped similarly to the outer edge of the at least one corner of the door frame.

14. The door of claim 11, further comprising:

a pin bar having locking pins, positioned proximate the door panel frame and pivotably attached to a pin bar link arm, the pin bar link arm being pivotably attached to the pin cam plate.

15. The door of claim 14, wherein the pin cam plate comprises a link arm attachment point to which both the corner bolt link arm and the pin bar link arms are pivotably attached.

16. The door of claim 11, wherein the corner bolt comprises a threaded interior end attached to one side of an L-shaped bracket, the other side of the L-shaped bracket being pivotally attached to the corner bolt link arm.

17. The door of claim 11, wherein the corner bolt comprises a threaded interior end attached to a first perpendicular surface of an L-shaped angle plate, said L-shaped angle plate having a second perpendicular surface which is facing and substantially near the surface of the door, thereby assisting in preventing pry attacks.

18. A locking system for a door, comprising:

a generally rectangular door panel frame defining a corner hole through at least one corner of the door panel frame;

a reinforcement channel disposed at the at least one corner, the reinforcement channel having tapered edges to fit into the at least one corner and comprising two generally parallel and spaced apart surfaces, each of the surfaces defining a reinforcement hole that is aligned with the corner hole;

a corner bolt link arm pivotably attached to a rotatable pin cam plate; and a corner bolt pivotably attached to the corner bolt link arm and positioned through the reinforcement channel and the corner hole.

19. The locking system of claim 18, further comprising:

a pin bar having locking pins, positioned proximate the door panel frame and pivotably attached to a pin bar link arm, the pin bar link arm being pivotably attached to the pin cam plate.

20. The locking system of claim 19, wherein the pin cam plate comprises a link arm attachment point to which both the corner bolt link arm and the pin bar link arms are pivotably attached.

21. The locking system of claim 18, wherein the corner bolt comprises a threaded interior end attached to one side of an L-shaped bracket, the other side of the L-shaped bracket being pivotally attached to the corner bolt link arm.

22. The locking system of claim 18, wherein the corner bolt comprises a threaded interior end attached to a first perpendicular surface of an L-shaped angle plate, said L-shaped angle plate having a second perpendicular surface which is facing and substantially near the surface of the door, thereby assisting in preventing pry attacks.

* * * * *